US006206984B1

(12) United States Patent
Inada et al.

(10) Patent No.: US 6,206,984 B1
(45) Date of Patent: Mar. 27, 2001

(54) NON-HEAT TREATED WIRE OR BAR STEEL FOR SPRINGS

(75) Inventors: Atsushi Inada; Nao Yoshihara; Nobuhiko Ibaraki, all of Kobe (JP)

(73) Assignee: Kabushiki Kaisha Kobe Seiko Sho, Kobe (JP)

( * ) Notice: Subject to any disclaimer, the term of this patent is extended or adjusted under 35 U.S.C. 154(b) by 0 days.

(21) Appl. No.: 09/303,603

(22) Filed: May 3, 1999

(30) Foreign Application Priority Data

May 13, 1998 (JP) ..... 10-130361

(51) Int. Cl.[7] ..... C21D 7/00; C22C 38/26; C22C 38/28

(52) U.S. Cl. ..... 148/333; 148/908; 148/598; 148/580; 420/110

(58) Field of Search ..... 148/333, 908, 148/598, 580; 420/110

(56) References Cited

U.S. PATENT DOCUMENTS 5,186,768 * 2/1993 Nomoto et al. ..... 148/908

FOREIGN PATENT DOCUMENTS

78514 * 6/1975 (JP) ..... 148/330
57-034333 * 7/1982 (JP) ..... 148/330
67847 * 4/1983 (JP) ..... 148/908

* cited by examiner

*Primary Examiner*—Deborah Yee
(74) *Attorney, Agent, or Firm*—Oblon, Spivak, McClelland, Maier & Neustadt, P.C.

(57) ABSTRACT

A non-heat treated wire or bar steel for springs which is characterized by having in its as-rolled state a tensile strength of 120–150 kgf/mm$^2$ and a bending breakage rate no higher than 15% when tested according to JIS Z-2248 under the condition of r/d=2.8 where r (mm) denotes the inside radius of the bending curvature and d (mm) denotes the diameter of the as-rolled stock.

12 Claims, No Drawings

NON-HEAT TREATED WIRE OR BAR STEEL FOR SPRINGS

BACKGROUND OF THE INVENTION

1. Field of the Invention

The present invention relates to a non-heat treated wire or bar steel for springs which possesses a high tensile strength of about 120–150 kgf/mm$^2$ and exhibits good cold bending properties in its as-hot rolled state even though it does not undergo heat treatment (such as quenching and tempering) after hot rolling.

2. Description of the Related Art

Springs are divided into hard-drawn ones and heat-treated ones if they are made of a high-strength steel wire or bar with a tensile strength greater than 100 kgf/mm$^2$. Hard-drawn springs are manufactured from intensively cold-drawn rod, typically piano wire made from eutectoid steel. Heat-treated springs are manufactured from rolled (or hot-rolled) and drawn rod by hot bending and ensuing heat treatment (quenching and tempering) or from previously heat-treated rod by cold bending.

Production of hard-drawn springs needs intense drawing and production of heat-treated springs needs heat treatment, as mentioned above, and they are only possible with large-scale facilities and heavy energy consumption and long processing time. If springs can be made from as-rolled rod without intense working and heat treatment, it would be possible to greatly save facilities and raw materials and to shorten the delivery period, and hence such a technology would be very useful.

The problem involved with as-rolled material is that it cannot be used as such (with a tensile strength in excess of 120 kgf/mm$^2$) because it is too poor in toughness and ductility to undergo cold bending and it breaks springs with insufficient impact resistance.

OBJECT AND SUMMARY OF THE INVENTION

The present invention was completed in view of the foregoing. It is an object of the present to provide a non-heat treated wire or bar steel for springs which possesses a high tensile strength and exhibits good bending properties in its as-rolled state.

According to the present invention, the non-heat treated wire or bar steel for springs (abbreviated as "the steel of the present invention" or "non-heat treated steel" hereinafter) is characterized by having in its as-rolled state a tensile strength of 120–150 kgf/mm$^2$ and a bending breakage rate no higher than 15% when tested according to JIS Z-2248 under the condition of r/d=2.8 where r (mm) denotes the inside radius for the bending curvature and d (mm) denotes the diameter of the as-rolled stock.

According to a preferred embodiment of the present invention, the non-heat treated steel is characterized by having a bending breakage rate no higher than 15% or still no higher than 6% when tested under the condition of r/d=1.4 where r and d are defined as above.

The steel of the present invention basically comprises 0.13–0.35% C, 0.1–1.8% Si, and 0.8–1.8% Cr (% means % by weight hereinafter). It further comprises 0.8–2.5% Mn and up to 0.08% Al (excluding 0%). It further comprises 0.005–0.15% Nb, 0.01–0.1% Ti, and 0.0005–0.01% B. It contains Ti and Nb such that their total amount is no less than 0.08%. It further comprises up to 0.2% V (excluding 0%). It further comprises up to 0.018% S (excluding 0%). According to a preferred embodiment, it comprises 0.13–0.35% C, 0.1–1.8% Si, 0.8– 1.8% Cr, 0.8–2.5% Mn, up to 0.08% Al (excluding 0%), 0.005–0.15% Nb, 0.01–0.1% Ti, 0.0005–0.01% B, up to 0.2% V (including 0%), up to 0.018% S (including 0%), and no less than 0.08% Nb+Ti, with the remainder being Fe and unavoidable impurities.

Incidentally, the scope of the present invention embraces springs and stabilizers manufactured from the steel of the present invention.

DESCRIPTION OF THE PREFERRED EMBODIMENTS

The present inventors carried out a series of researches in order to provide a non-heat treated wire or bar steel for springs which possesses a high tensile strength and exhibits good bending properties in its as-hot rolled state. As a result, it was found that the conventional technologies are mostly intended to improve tensile strength and are not intended to provide non-heat treated steel which is superior in both tensile strength and bending properties. It was also found that it is possible to improve tensile strength simply by growing the martensite-based structure or bainite-based structure but such structure control alone is not enough if it is desirable to improve both tensile strength and bending properties.

There is disclosed in Japanese Patent Laid-open Nos. 30653/1986, 30650/1986, and 87749/1989 a non-heat treated spring steel which has a tensile strength as high as about 200 kgf/mm$^2$ because it has the martensite-based structure grown in its as-rolled state. Unfortunately, a steel with such an extremely high tensile strength is remarkably poor in bending properties. It is capable of bending to some extent but is subject to occasional breakage due to bending when it is bent lightly such that the ratio of r/d is 2.8 (for example), where r is the radius of bending curvature and d is the diameter of stock, as in the case of automotive suspension springs. It is also subject to frequent breakage or cracking due to bending when it is bent sharply such that the ratio of r/d is 1.4 (for example).

On the other hand, there is disclosed in Japanese Patent Laid-open No. 239589/1993 a high-strength non-heat treated steel which has both hardness and toughness owing to its bainite-based structure. However, this steel is poor in tensile strength (100 kgf/mm$^2$ at the highest), and nothing is disclosed about bending properties.

All of the above-mentioned disclosures are intended mainly to improve tensile strength but are not intended to improve both tensile strength and bending properties.

The present inventors carried out extensive studies to provide "a non-heat treated steel superior in both tensile strength and bending properties." As a result, it was found that good bending properties are attained by a comparatively low carbon content (say, 0.13–0.35%) and by the bainite-based structure, that the bainite structure which is stable under various rolling conditions for various stock diameters is obtained effectively by incorporation with Nb, B, and Ti; that Nb particularly contributes to improvement in tensile strength due to the formation of bainite structure; that improvement in bending properties is effectively achieved by grain refinement by Nb and Ti; and that further improvement in bending properties is achieved if retained austenite remains in an adequate amount owing to incorporation with Si. Studies based on the above-mentioned findings led to another finding that it is necessary that the upper limit of tensile strength should be 150 kgf/mm$^2$ (particularly 120–150 kgf/mm$^2$) if the non-heat treated steel is to have both high tensile strength and good bending properties. Thus it was found that the steel having a tensile strength adjusted in such an extent has also good bending properties and hence is capable of bending in its as-rolled state without breaking even in the case of sharp bending (with a small radius of curvature, say, 1.4 times the diameter). The present invention was completed on the basis of these findings.

The present inventors studied the factors that affect bending properties in connection with tensile strength. As a result, it was found that it is possible to improve both tensile strength and bending properties if the steel has bainite as the main structure and contains subtly controlled chemical components (especially Nb, Ti, and B). The point of the present invention resides in this finding. In other words, the present invention is technically significant because of the finding that the non-heat treated steel can possess both high tensile strengths and good bending properties only when its tensile strength is adjusted within a range of 120–150 kgf/mm$^2$.

According to the present invention, the non-heat treated wire or bar steel for springs is characterized by possessing a high tensile strength of 120–150 kgf/mm$^2$ in its as-rolled state and also possessing a bending breakage rate no higher than 15% when tested according to JIS Z-2248 under the condition of r/d=2.8. Moreover, the steel of the present invention is characterized by possessing a bending breakage rate no higher than 15%, preferably no higher than 6%, when tested under the severe condition of r/d=1.4. Therefore, the present invention is of great use in these respects.

The following describes the chemical components constituting the steel of the present invention.

As mentioned above, the most important point of the present invention resides in the finding that for the steel to have "both high tensile strength and good bending properties," it is necessary to control the amounts of elements, particularly Nb, Ti, and B, in the steel. The rationale for specifying the amounts of these elements is explained below.

Nb: 0.005–0.15%

This element greatly contributes to tensile strength, invariably gives rise to the bainite structure for high strength, and promotes grain refinement, thereby improving bending properties and impact strength. For Nb to produce its full effect, it should be added in an amount no less than 0.005%, preferably no less than 0.015%, more preferably no less than 0.030%. An amount in excess of 0.15% is wasted without additional effect. A desirable amount to achieve the object economically is no more than 0.10%, preferably no more than 0.07%.

Ti: 0.01–0.1%

This element contributes to grain refinement, thereby improving bending properties and impact resistance. For Ti to produce its full effect, it should be added in an amount no less than 0.01%, preferably no less than 0.02%, more preferably no less than 0.03%. An amount in excess of 0.1% is wasted without additional effect. A desirable amount to achieve the object economically is no more than 0.09%, preferably no more than 0.07%.

Incidentally, the effect of Ti is enhanced synergistically by Nb which is added in an amount more than prescribed. It is recommended that the total amount of Ti and Nb be no less than 0.08%, preferably no less than 0.10%.

B: 0.0005–0.01%

B as well as Nb is indispensable for the bainite structure. For B to produce its full effect, it should be added in an amount no less than 0.0005%, preferably no less than 0.0010%, more preferably no less than 0.0015%. An amount in excess of 0.01% is wasted without additional effect. An adequate amount to achieve the object economically is no more than 0.0080%, preferably no more than 0.0060%.

According to the present invention, the amount of other elements should be controlled as follows.

C: 0.13–0.35%

The amount of C should be no less than 0.13% so that the steel has a tensile strength no lower than 120 kgf/mm$^2$ and the resulting springs have a high yield strength. An adequate amount is no less than 0.18%, preferably no less than 0.20%. An amount in excess of 0.35% has an adverse effect on bending properties although it does not change tensile strength beyond the range of 120–150 kgf/mm$^2$. An adequate amount is no more than 0.33%, preferably no more than 0.30%.

Si: 0.1–1.8%

This element enhances the sag resistance of springs. Its amount should preferably be no less than 0.1%. With an amount no less than 0.6%, it gives rise to a stable retained austenite structure, thereby greatly improving bending properties. Therefore, its adequate amount is no less than 0.6%, preferably no less than 0.8%. However, with an amount in excess of 1.8%, it gives rise to retained austenite more than necessary, thereby reducing the proof stress. Therefore, its adequate amount is no more than 1.6%, preferably no more than 1.4%, and more preferably no more than 1.0%.

Cr: 0.8–1.8%

This element (like Mn mentioned later) improves hardenability and prevents the formation of soft ferrite structure and pearlite structure. Its recommended amount is no less than 0.8%, preferably no less than 0.9%, more preferably no less than 1.1%. With an amount in excess of 1.8%, it tends to form the martensite structure which adversely affects bending properties. Therefore, its recommended amount is no more than 1.8%, preferably no more than 1.7%, more preferably no more than 1.6%.

Mn: 0.8–2.5%

This element improves hardenability and prevents the formation of soft ferrite structure and pearlite structure. Its recommended amount is no less than 0.8%, preferably no less than 1.0%, more preferably no less than 1.2%. With an amount in excess of 2.5%, it tends to form the martensite structure which adversely affects bending properties. Therefore, its recommended amount is no more than 2.5%, preferably no more than 2.3%, more preferably no more than 2.0%.

Al: up to 0.08% (excluding 0%)

This element invariably promotes grain refinement by Ti and Nb. In the case where the rolling temperature is high for manufacturing reasons or the content of Ti and Nb is low, its recommended amount is no less than 0.015%, preferably no less than 0.020%, more preferably 0.025%. With an amount in excess of 0.08%, this element leads to an increase in oxide inclusions, reducing toughness. Therefore, its recommended amount is no more than 0.08%, preferably no more than 0.060%, and more preferably no more than 0.045%.

V: up to 0.2% (excluding 0%)

This element enhances tensile strength in the case where other alloying elements than this element do not provide sufficient tensile strength. Its recommended amount is no less than 0.05%, preferably no less than 0.07, more preferably no less than 0.10%. However, this element tends to slightly weaken bending properties, and proper adjustments are necessary. Its recommended amount is no more than 0.2%, preferably no more than 0.18%, and more preferably no more than 0.16%, most desirably less than 0.01%.

S: up to 0.018% (including 0%)

This element remarkably enhances impact resistance and hence effectively prevents brittle fracture when its content is no more than 0.018%. The content of this element should be properly controlled according to uses.

The steel of the present invention should be produced in such a way as to provide a uniform structure of high strength and high ductility. To achieve this object, it is necessary to employ a rather low billet heating temperature (800°–950° C.) and to properly control the amount of cooling water so that the stock temperature will not exceed 1000° C., which is essential to prevent coarse grains from occurring during rolling which evolves heat due to working. The result of high billet heating temperature is that coarse austenite grains occur during hot rolling and the martensite structure (which is hard but poor in ductility) occurs in a high ratio in the subsequent cooling step, impairing the uniformity of the structure. Cooling after hot rolling greatly affects the strength and ductility of the steel; it is necessary to keep the cooling rate at 0.1–2.5° C./s when the temperature decreases from 650° C. to 300° C. The foregoing is merely intended to illustrate one process of producing the steel of the present invention but by no means to exclude other processes.

The steel of the present invention is useful as a non-heat treated wire or bar steel for springs, particularly as a non-heat treated steel for stabilizers. The stabilizer is an important part of the suspension system of an automobile which reduces roll and ensures a good ride. It counteracts the tilt of the vehicle body during cornering but has no effect when the spring deflection at both wheels is equal. It sometimes functions also as a suspension link. It is an important safety device to support the front and rear loads of a vehicle. The steel of the present invention is very useful for non-heat treated stabilizers, not for hot-worked stabilizers, because of its high tensile strength comparable to that of conventional hot-worked stabilizers and its good cold bending properties required of non-heated treated steel.

Unlike heat-treated steel, the steel of the present invention obviates in production of stabilizers the necessity of two large-sized furnaces (one for hot bending and one for tempering) and expensive hot dies (as many as types of products to be made) and leveling steps, all of which cost producers. What it basically needs is an NC cold bender and a stress relieving annealing furnace, which leads to a great cost reduction and a remarkable energy and time saving. Therefore, the present invention is of great industrial significance.

In the meantime, the term "non-heat treatment" as used in the present invention simply implies that the steel does not need the thermal refining (austenite heating → quenching → tempering) which is commonly carried out to improve strength and toughness, but does not imply that it does not need any heat treatment. Therefore, the present invention does not exclude such heat treatment as stress relieving annealing (to remove residual stress after cold working) and light drawing (to remedy straightness and surface properties), and such heat treatment to be carried out according to need is within the scope of the present invention. In addition, heating and quenching (such as induction hardening) to be performed on a restricted part which needs high hardness are also embraced by the scope of the present invention.

The steel of the present invention as mentioned above can be made into desired springs and stabilizers (and other machine parts) by rolling, cutting, cold bending, stress relieving annealing (optional), and shot-peening and coating (optional). It does not need the steps of thermal refining.

The above-mentioned steps can be carried out, without specific restrictions, under the conditions which are commonly accepted for the production of high-strength parts (such as springs) from non-heat treated steel.

The invention will be understood more readily by reference to the following examples; however, these examples are intended to illustrate the invention and are not to be construed to limit the scope of the invention, and variations may be made by one skilled in the art without departing from the spirit and scope of the invention.

EXAMPLES

Steel samples (Nos. 1 to 13) varying in composition as shown in Table 1 were prepared by using a small experimental furnace, and they were made into billets (155 mm square) by hot forging. Each billet was heated to 900° C. and hot-rolled into a steel bar, 18 mm in diameter. Hot rolling was accompanied by water cooling according to circumstances so as to keep the stock temperature below 1000° C. The rolled steel bar was cooled from 650° C. to 300° C. at an average cooling rate of 1.0° C./s.

The resulting steel bar was cut to a length of 400 mm (without surface finishing) to give specimens for tensile test and bending test. Eighteen specimens in total were obtained from the top, middle, and bottom portions (six each). They underwent tensile test according to JIS Z-2248, with the gauge length being 200 mm. Another eighteen specimens in total were obtained from the top, middle, and bottom portions (six each). They underwent three-point bending test at room temperature, and they were examined for cracking and their breakage rate was calculated. Bending was accomplished by using two kinds of jigs, one having a radius of curvature of 25 mm, which corresponds to 1.4 times the diameter of the as-rolled bar, and the other having a radius of curvature of 50 mm, which corresponds to 2.8 times the diameter of the as-rolled bar. In addition, Charpy impact test was performed on specimens (conforming to JIS No. 3) cut out of the above-mentioned bar.

The results of the tests are shown in Table 2.

TABLE 1

| Sample No. | C | Si | Mn | P | S | Cr | V | Nb | Ti | B | Al | Ti + Nb |
|---|---|---|---|---|---|---|---|---|---|---|---|---|
| 1 | 0.23 | 1.50 | 1.58 | 0.012 | 0.008 | 1.02 | 0 | 0.041 | 0.070 | 0.0020 | 0.025 | 0.111 |
| 2 | 0.17 | 0.82 | 1.92 | 0.006 | 0.015 | 1.60 | 0 | 0.052 | 0.060 | 0.0019 | 0.017 | 0.112 |
| 3 | 0.22 | 0.55 | 1.60 | 0.007 | 0.011 | 1.55 | 0 | 0.054 | 0.055 | 0.0018 | 0.032 | 0.019 |
| 4 | 0.28 | 0.21 | 1.55 | 0.021 | 0.009 | 1.60 | 0 | 0.039 | 0.042 | 0.0020 | 0.025 | 0.081 |
| 5 | 0.25 | 0.69 | 1.57 | 0.010 | 0.010 | 1.53 | 0.18 | 0.042 | 0.038 | 0.0021 | 0.016 | 0.080 |
| 6 | 0.33 | 1.05 | 1.63 | 0.008 | 0.020 | 1.73 | 0 | 0.053 | 0.039 | 0.0023 | 0.027 | 0.092 |
| 7 | 0.26 | 0.80 | 1.67 | 0.016 | 0.015 | 1.41 | 0 | 0.021 | 0.028 | 0.0021 | 0.033 | 0.049 |
| 8 | 0.23 | 1.62 | 1.55 | 0.010 | 0.011 | 1.10 | 0 | 0.055 | 0.056 | 0.0025 | 0.003 | 0.111 |

TABLE 1-continued

| Sample No. | C | Si | Mn | P | S | Cr | V | Nb | Ti | B | Al | Ti + Nb |
|---|---|---|---|---|---|---|---|---|---|---|---|---|
| 9 | 0.27 | 0.15 | 1.56 | 0.014 | 0.006 | 1.11 | 0.17 | 0 | 0.071 | 0.0017 | 0.031 | 0.071 |
| 10 | 0.26 | 0.22 | 1.92 | 0.011 | 0.010 | 1.15 | 0 | 0 | 0.044 | 0.0020 | 0.024 | 0.044 |
| 11 | 0.29 | 1.50 | 1.65 | 0.008 | 0.006 | 1.45 | 0.08 | 0.046 | 0.083 | 0.0018 | 0.002 | 0.109 |
| 12 | 0.37 | 0.44 | 1.55 | 0.008 | 0.007 | 1.38 | 0 | 0.051 | 0.037 | 0.0022 | 0.019 | 0.088 |
| 13 | 0.26 | 0.70 | 1.71 | 0.014 | 0.011 | 1.52 | 0 | 0.046 | 0.042 | 0 | 0.014 | 0.088 |

TABLE 2

| Sample No. | Average TS ($kgf/mm^2$) | Standard deviation of TS ($kgf/mm^2$) | Reduction of area (%) | Elongation (%) | Impact value ($kgf \cdot m/cm^2$) | Breakage rate in bending test (%) r/d = 1.4 | Breakage rate in bending test (%) r/d = 2.8 |
|---|---|---|---|---|---|---|---|
| 1 | 128.1 | 3.5 | 42.5 | 15.5 | 10.8 | 0 | 0 |
| 2 | 136.2 | 2.8 | 40.8 | 14.6 | 10.1 | 0 | 0 |
| 3 | 138.7 | 3.4 | 39.9 | 12.9 | 9.6 | 5.6 | 0 |
| 4 | 140.5 | 4.1 | 38.7 | 11.7 | 9.5 | 5.6 | 0 |
| 5 | 148.0 | 5.6 | 36.6 | 11.0 | 9.3 | 5.6 | 0 |
| 6 | 146.0 | 3.0 | 35.8 | 8.9 | 9.1 | 11 | 0 |
| 7 | 122.3 | 8.5 | 41.1 | 12.6 | 9.3 | 5.6 | 0 |
| 8 | 131.2 | 3.3 | 39.7 | 11.6 | 9.4 | 5.6 | 0 |
| 9 | 112.1 | 12.5 | 42.8 | 11.8 | 9.5 | 11 | 5.6 |
| 10 | 128.6 | 8.6 | 38.7 | 11.4 | 8.2 | 94 | 17 |
| 11 | 154.6 | 12.2 | 28.9 | 4.2 | 3.4 | 100 | 61 |
| 12 | 131.5 | 10.1 | 29.4 | 5.5 | 3.9 | 100 | 22 |
| 13 | 111.3 | 14.9 | 42.5 | 10.9 | 10.0 | 17 | 5.6 |

Data in Tables 1 and 2 are explained as follows. Samples numbered from 1 to 8 represent the examples which meet the requirement of the present invention that as-rolled specimens have a tensile strength (TS) in the range of 120 to 150 $kgf/mm^2$ and a breakage rate no higher than 15% (for r/d=2.8).

Samples numbered 1 and 2 have the chemical composition which is recommended in the present invention. They are good in bending properties, with the breakage rate being zero for r/d=2.8 as well as r/d=1.4. They are also very good in other characteristic properties (such as area of reduction, elongation, and impact value).

Samples numbered from 3 to 8 contain Nb, Ti, and B in amounts as specified in the present invention. (These elements are important for improvement in both tensile strength and bending properties.) However, they contain Si, S, and Al in amounts outside the preferred range specified in the present invention. Therefore, they are good in tensile strength and bending properties but are slightly poor in elongation and bending properties under severe conditions. Effects of individual elements are explained below.

Samples numbered 3 and 4 contain Si in an amount outside the preferred range (no less than 0.6%) specified in the invention; therefore, they are slightly poor in elongation and in bending properties (with a low breakage rate under severe conditions).

Sample No. 5 contains V in an amount outside the preferred range (no more than 0.16% ) specified in the invention; therefore, it is good in tensile strength but is slightly poor in toughness and bending properties (with a low breakage rate).

Sample No. 6 contains S in an amount outside the range (no more than 0.018%) specified in the invention; therefore, it is poor in elongation and impact value.

Sample No. 7 contains Ti and Nb in a total amount outside the range (no less than 0.08%) specified in the invention; therefore, it is slightly poor in tensile strength and impact value.

Sample No. 8 is substantially identical with sample No. 1 except for Al whose content is outside the preferred range (no less than 0.015%) specified in the invention; therefore, it is slightly inferior in bending properties to sample No. 1.

By contrast, samples numbered from 9 to 13 do not accord with the present invention and hence they are poor in either tensile strength or bending properties.

Sample No. 9 does not contain Nb; therefore, it lacks the stable bainite structure and is poor in tensile strength with great fluctuation. Some specimens are poor in bending properties despite their low average tensile strength.

Sample No. 10 does not contain Nb as in sample No. 9 but contains Mn and Cr in large amounts so as to attain the desired level of tensile strength (in conjunction with the raised rolling temperature). Therefore, it has a tensile strength higher than 120 $kgf/mm^2$ but is poor in bending properties. This result suggests that Nb greatly contributes to improvement in bending properties through the formation of bainite structure.

Sample No. 11 has the chemical composition that accords with the invention; however, due to a high cooling rate after rolling, it has a tensile strength exceeding 150 kgf /$m^2$ and is extremely poor in bending properties with low elongation and impact value.

Sample No. 12 contain C in an amount outside the range (no more than 0.35%) specified in the invention; therefore, it is extremely poor in bending properties with low impact value despite its tensile strength no higher than 150 $kgf/m^2$.

Sample No. 13 does not contain B; therefore, it is poor in tensile strength and has a greatly fluctuating tensile strength due to non-uniform structure. Some specimens are poor in bending properties.

Being constructed as mentioned above, the present invention efficiently provides a non-heat treated wire or bar steel for springs which possesses a high tensile strength of about 120–150 kgf/mm$^2$ and exhibits good cold bending properties in its as-hot rolled state.

What is claimed is:

1. A non-heat treated wire or bar steel comprising

Nb: 0.005–0.15 wt %,

Ti: 0.01–0.1 wt %,

B: 0.0005–0.01 wt %,

Cr: 1.02–1.8 wt %, and a remainder of Fe and unavoidable impurities, wherein the steel has in its as-rolled state a tensile strength of 120–150 kgf/mm$^2$ and a bending breakage rate no higher than 15% when tested according to JIS Z-2248 under a condition of r/d=2.8 where r(mm) denotes an inside radius of a bending curvature and d(mm) denotes a diameter of the steel in the as-rolled state.

2. The steel as defined in claim 1, wherein the steel has a bending breakage rate no higher than 15% when tested according to JIS Z-2248 under a condition of r/d=1.4 where r(mm) denotes an inside radius of a bending curvature and d(mm) denotes a diameter of the steel in the as-rolled state.

3. The steel as defined in claim 2, wherein the steel has a bending breakage rate no higher than 6% when tested according to JIS Z-2248 under a condition of r/d=1.4 where r(mm) denotes an inside radius of a bending curvature and d(mm) denotes a diameter of the steel in the as-rolled state.

4. The steel as defined in any one of claims 1, 2 or 3, further comprising C: 0.13–0.35 wt %, and Si: 0.1–1.8 wt %.

5. The steel as defined in claim 4, further comprising

Mn: 0.8–2.5 wt %, and

Al: more than 0—less than or equal to 0.08 wt %.

6. The steel as defined in claim 1, wherein a total amount of Ti and Nb is no less than 0.08 wt %.

7. The steel as defined in claim 1, further comprising no more than 0.2 wt % V (excluding 0 wt %).

8. The steel as defined in claim 1, further comprising no more than 0.18 wt % S (including 0 wt %).

9. The steel as defined in any one of claims 1, 2 or 3 comprising C: 0.13–0.35 wt %, Si: 0.1–1.8 wt %, Cr: 1.02–1.8 wt %, Mn: 0.8–2.5 wt %, Al: more than 0—less than or equal to 0.08 wt %, Nb: 0.005–0.15 wt %, Ti: 0.01–0.1 wt %, B: 0.0005–0.01 wt %, V: up to 0.2 wt % (including 0 wt %), S: up to 0.018 wt % (including 0 wt %), Nb+Ti: no less than 0.08 wt %, and a remainder of Fe and unavoidable impurities.

10. A method of making a steel, the method comprising forging a steel composition, and forming the non-heat treated wire or bar steel of claim 1.

11. A steel spring consisting of

C: 0.13–0.35 wt %.

Si: 0.1–1.8 wt %.

Cr: 1.02–1.8wt %.

Mn: 0.8–2.5 wt %.

Al: more than 0—less than or equal to 0.08 wt %.

Nb: 0.005–0.15 wt %,

Ti: 0.01–0.1 wt %,

B: 0.0005–0.01 wt %,

V: up to 0.2 wt % (including 0 wt %),

S: up to 0.018 wt % (including 0 wt %,

Nb+Ti: no less than 0.08 wt %, and a remainder of Fe and unavoidable impurities.

12. A method of making a steel spring, the method comprising forging a steel composition; and forming the steel spring of claim 11.

* * * * *